United States Patent [19]

Dragone

[11] 4,162,841

[45] Jul. 31, 1979

[54] APPARATUS FOR DEVELOPING FILMS, AND PARTICULARLY X-RAY FILMS AS EMPLOYED IN DENTAL APPLICATIONS

[76] Inventor: Giorgio Dragone, Via Redaelli, 2, Olginate (Como), Italy

[21] Appl. No.: 839,026

[22] Filed: Sep. 30, 1977

[30] Foreign Application Priority Data

Jan. 10, 1977 [IT] Italy ..... 19133 A/77

[51] Int. Cl.[2] ..... G03D 3/10

[52] U.S. Cl. ..... 354/310; 354/311; 354/316; 354/322

[58] Field of Search ..... 354/307, 310, 311, 312, 354/315, 316, 319, 320, 322; 250/468, 470, 471

[56] References Cited

U.S. PATENT DOCUMENTS

| | | | |
|---|---|---|---|
| 3,446,134 | 5/1969 | Brown et al. | 354/322 |
| 3,494,273 | 2/1970 | Kampf et al. | 354/322 |
| 3,559,554 | 2/1971 | Schmidt | 354/310 |
| 3,727,533 | 4/1973 | Perl | 354/312 |
| 3,769,897 | 11/1973 | Zwettler et al. | 354/322 |
| 3,828,195 | 8/1974 | Snarr | 354/307 |
| 3,833,917 | 9/1974 | Schmidt | 354/310 |

*Primary Examiner*—L. T. Hix
*Assistant Examiner*—Alan Mathews
*Attorney, Agent, or Firm*—Guido Modiano; Albert Josif

[57] ABSTRACT

A film developing apparatus in which an exposed film still enclosed in its protective wrapping is inserted into a magazine and the magazine is put as a cover on the apparatus. The film is extracted from the magazine by pulling a tab of the protective wrapping projecting out of the apparatus and is then transferred in succession through developing, fixing and washing baths internally to the apparatus. The film is then reinserted into the magazine upon completion of the developing step. Transfer of the film through the developing and washing baths occurs by a gripper entrained by an endless belt controlled by an electronic control device.

7 Claims, 19 Drawing Figures

APPARATUS FOR DEVELOPING FILMS, AND PARTICULARLY X-RAY FILMS AS EMPLOYED IN DENTAL APPLICATIONS

BACKGROUND OF THE INVENTION

This invention relates to an apparatus for developing exposed films, and particularly X-ray films or plates as used in the dental field.

Radiographic plates for diagnostic purposes are currently widely employed in modern odontoiatrics, thereby any dental ambulatory is expected to include laboratory and equipment facilities for the development of tooth radiographs, which are usually obtained with periapical plates of standardized design. However, this often poses serious difficulties to many such ambulatories, including space problems, since a suitable room must be specially reserved for these facilities, as well as personnel problems, since a skilled person is to be put in charge of them. To obviate such shortcomings, some apparata have been proposed for automatically developing radiographic plates in particular. While these apparata did contribute positively to the art, by making the operator's task a less harduous one, and one that may be performed by the dentist himself or his assistant, although to the detriment of their more specifically medical availability, they still leave much to be desired under several aspects. The majority of such apparata still require a dark room, as they are not designed for operation in a lighted environment.

Those prior art apparata which happen to be suitable for operation in a lighted room have some problems with the insertion of the plates, and generally make use of dark sleeves wherethrough the plate can be manually released from its case or wrapping and directly introduced into the first stage of the developing process. Furthermore, the consumption of acid and developing agent is generally rather high, and the danger exists that the treatment baths may damage the mechanical components through inadvertent spilling, overflows or splashes, or through the action of their fumes.

SUMMARY OF THE INVENTION

It is a general object of this invention to provide a novel apparatus capable of obviating such drawbacks, as mentioned above, in developng processes for radiographic or X-ray plates or films, and particularly in dental ambulatory applications.

It is a particular object of the invention to provide a photographic development apparatus, which may be used in full light conditions, in a completely automatic type of operation, and without requiring any specialized skill.

It is a further object to provide an apparatus which is equipped with a loading system wherein all that is required to initiate a developing process is that an exposed radiographic plate or film be inserted thereinto, while still enclosed in its original protective case or wrapping.

These objects are achieved by a film developing apparatus, in particular for X-ray films as employed in dental applications, comprising an opaque enclosure containing developing and washing baths and a means adapted to entrain and transfer a film to the developing and washing baths, an opening through said enclosure for the insertion of said film, and a magazine adapted to light-tight seal said opening and receive the film as wrapped in its protective wrapping.

BRIEF DESCRIPTION OF THE DRAWINGS

The invention features, operation and advantages will be more clearly understood from a detailed description of a preferred, but not restrictive, embodiment thereof, as given hereinafter by way of example and with reference to the accompanying drawings, where.

DESCRIPTION OF THE PREFERRED EMBODIMENTS

Figure 6A:
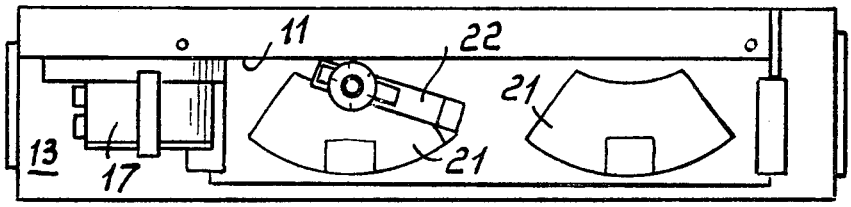
FIGS. 6*a* and 6*b* are respectively a front view of a first control panel and a plan view of a second control panel.
Figure 6B:
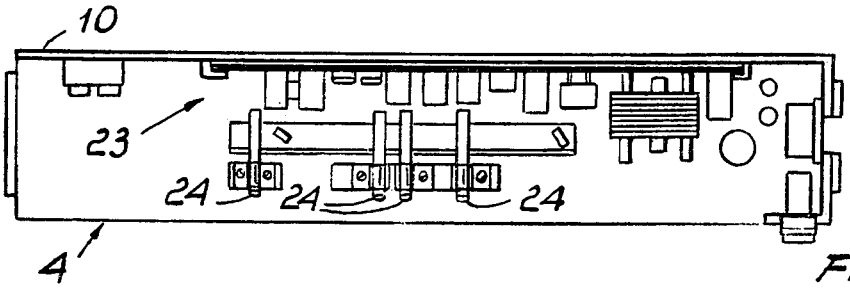

With reference to FIGS. 1 to 5 of the drawings, the numeral 1 denotes the enclosure or housing defined by a case or box 2, a cover plate 3 and panel 4, which together enclose or support all of the components involved in the film developing process. The box 2 and cover plate 3 define together a light tight housing with opaque walls, which once assembled is light-proof, within which housing the photographic process may be carried out as if in a dark room, regardless of the room lighting. The light tight seal is obtained by having the cover edges overlap the box edges, and by painting in black any parts which are likely to produce light reflection. The cover plate 3 defines an opening 3' which is light-tight closed by a cover 5 defining a film receiving magazine as will be explained later. The box 2 has a space 6 wherein a partitioned tray 7 for photographic baths is inserted slidably. The panel 4 forms, in turn, a special front cover, including a front wall 8, sidewall 9, and base plate 10 (FIG. 4), and defines a fully insulated space for the controls in association with a projecting roof 11, part of an end wall 12 and a longitudinal wall 13 of the box. Above the roof 11 of the box, and between the latter and the cover plate 3, there remains a flat space for the installation therein of entraining means effective to entrain and transfer a film to the photographic baths, the means comprising a conveyor in form of a drive chain 14, for endless circulation between two sprockets 15 and 16, the sprocket 15 being driven by an electric motor 17, a guide 18 extending substantially parallel to the conveyor 14, and a slider 19 which is slidable on the guide 18 and is made rigid perpendicularly with a bracket whereto is mounted a gripping device or movable gripper 20, to be described hereinafter. Making reference in particular to FIGS. 6*a* and 6*b* as well as to the preceding ones, to the wall 13, namely to the face of the box 2 toward the control space, there are mounted two resistors 21 for heating the development baths in the tray 7 through the wall 13. A wiping contact 22 on one of those resistors allows temperature to be adjusted. Onto the base plate 10, there is mounted the automation electric system, indicated generally at 23, which is basically a timer circuit, four magnetic relays or solenoids 24 whereof constitute as many operational detent switches. This circuit is no further discussed in detail herein, since it is known per se and foreign to the invention, and it will be pointed out but that it comprises two knobs 25 of potentiometers for adjusting the fixing time and developing time, respectively, telltale lamps 26, a master switch 27, a fuse 28, an electric socket 29, and a key 30 for the starting operation.

Figure 7:
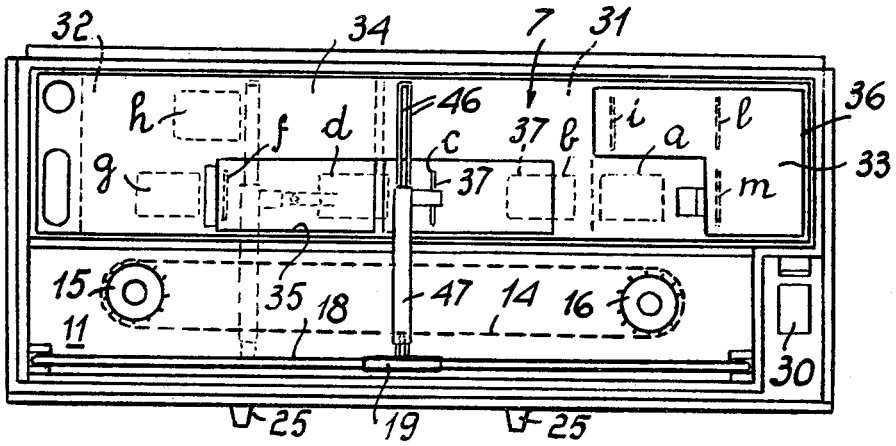
FIG. 7 is a view similar to FIG. 3, illustrating operational steps of the apparatus.

The tray 7 is partitioned into a developing receptacle 31 containing a developing bath, fixing receptacle 32 containing a fixing bath, and wash-up receptacle 33 containing a washing bath, and is closed by a cover panel 34 resting thereon, wherethrough a window 35 is cut for the developing and fixing baths and a window 36 for the wash-up bath. Thus a continuous surface is provided between the receptacles. Advantageously, the tray is made of an acid-resisting and easily washable plastics, such as PVC, polyethylene, and the like. FIG. 7 shows in plan view the operation sequence through the path followed by a radiographic plate or film 37 from its insertion at a, through its forward advance b, development immersion c, transfer d, fixing immersion f, transfer g, h, to the wash-up i, l, m.

Figure 8:
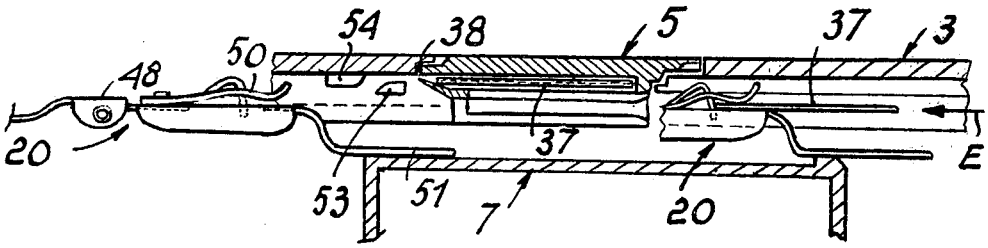
FIG. 8 is a sectional view taken along the line VIII—VIII of FIG. 5.
Figure 9:
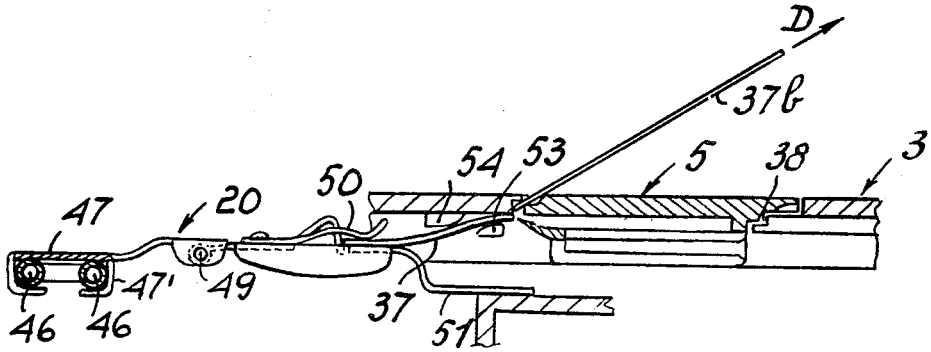
FIG. 9 is a sectional view similar to FIG. 8 but at a different step or stage of the developing process.

FIGS. 8 and 9 illustrate how the magazine 5 is inserted into the opening 3′ defined by the cover plate 3, with labyrinth light tight seals 38 for the purpose of inserting an exposed film 37 in a protected manner.

Figure 11:
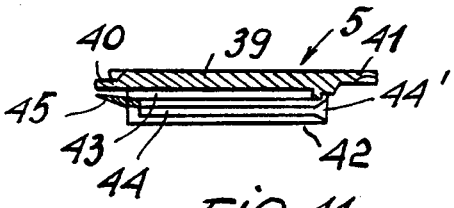
FIG. 11 shows the same in longitudinal section.
Figure 10:
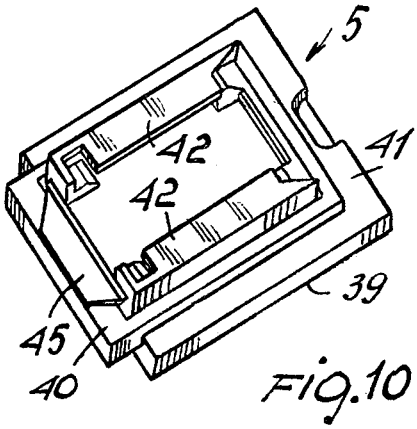
FIG. 10 shows in perspective the film loading magazine.
Figure 13:
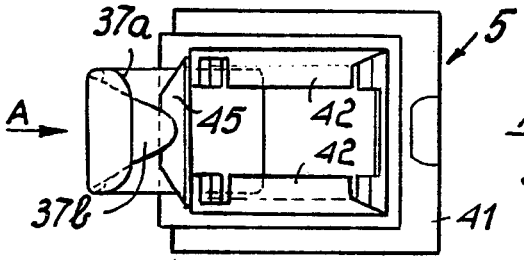
FIGS. 13 and 14 are plan views of the loading magazine during film loading steps.
Figure 14:
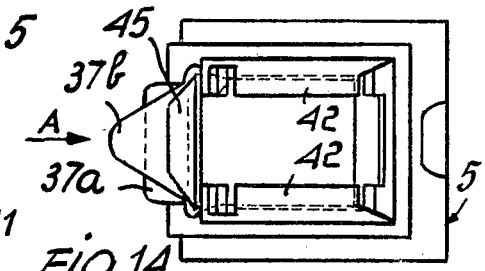
Figure 15:
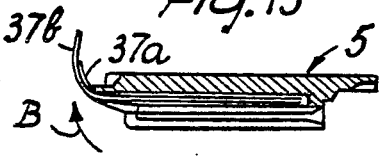
FIGS. 15 and 16 are longitudinal section views of the loading magazine containing the film and of its insertion onto the apparatus cover plate.
Figure 16:
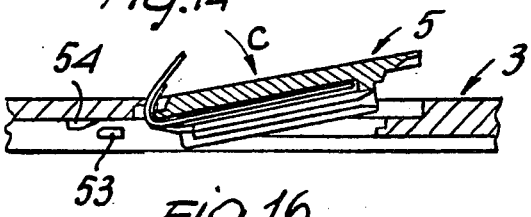
Figure 17:
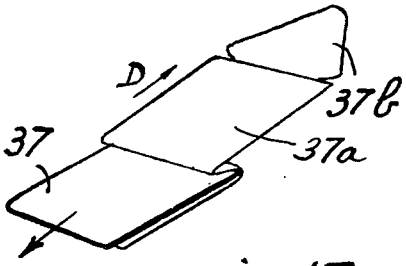
FIG. 17 shows in perspective a periapical film with its case or wrapping being detached.

FIG. 10 shows the loading magazine emptied, in perspective from below, i.e. from the portion which is inserted in the apparatus, and FIG. 11 is a sectional view of the loading magazine. The loading magazine 5 comprises a rectangular plate 39, wherefrom project a wing 40 opposite to border 41 to close in labyrinth seal fashion the window or opening 3′, as explained above. A film carrier frame extends from the plate 39 having two opposite sides, each denoted with the same numeral 42, and each provided with two internal grooved guides forming in pairs a first or upper seat 43 and a second or lower seat 44 for the film. The first seat 43, or loading seat, is preceded by a spring-loaded retaining film exit mouth having an upper lip formed by the wing 40 and a lower lip 45 connecting the guides defining the seat 43. The second seat 44 has an entrance mouth or lead-in 44′arranged opposite to the exit mouth of the first seat 43. Each seat is blind, i.e. can only be loaded from one side or mouth.

Figure 1:
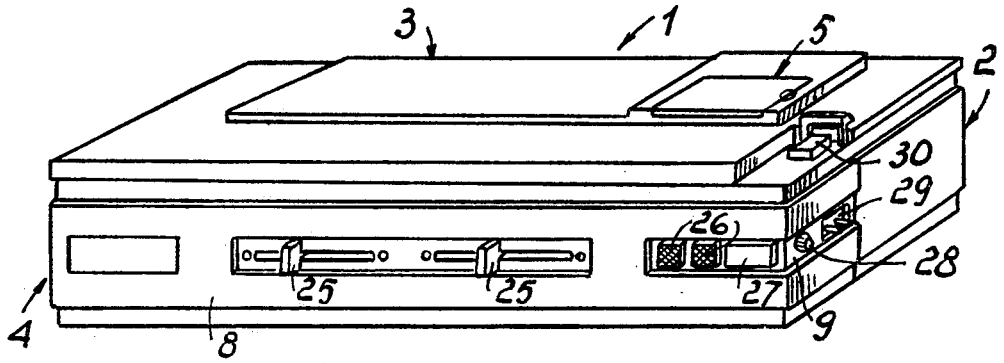
FIG. 1 shows in perspective the apparatus enclosure.
Figure 2:
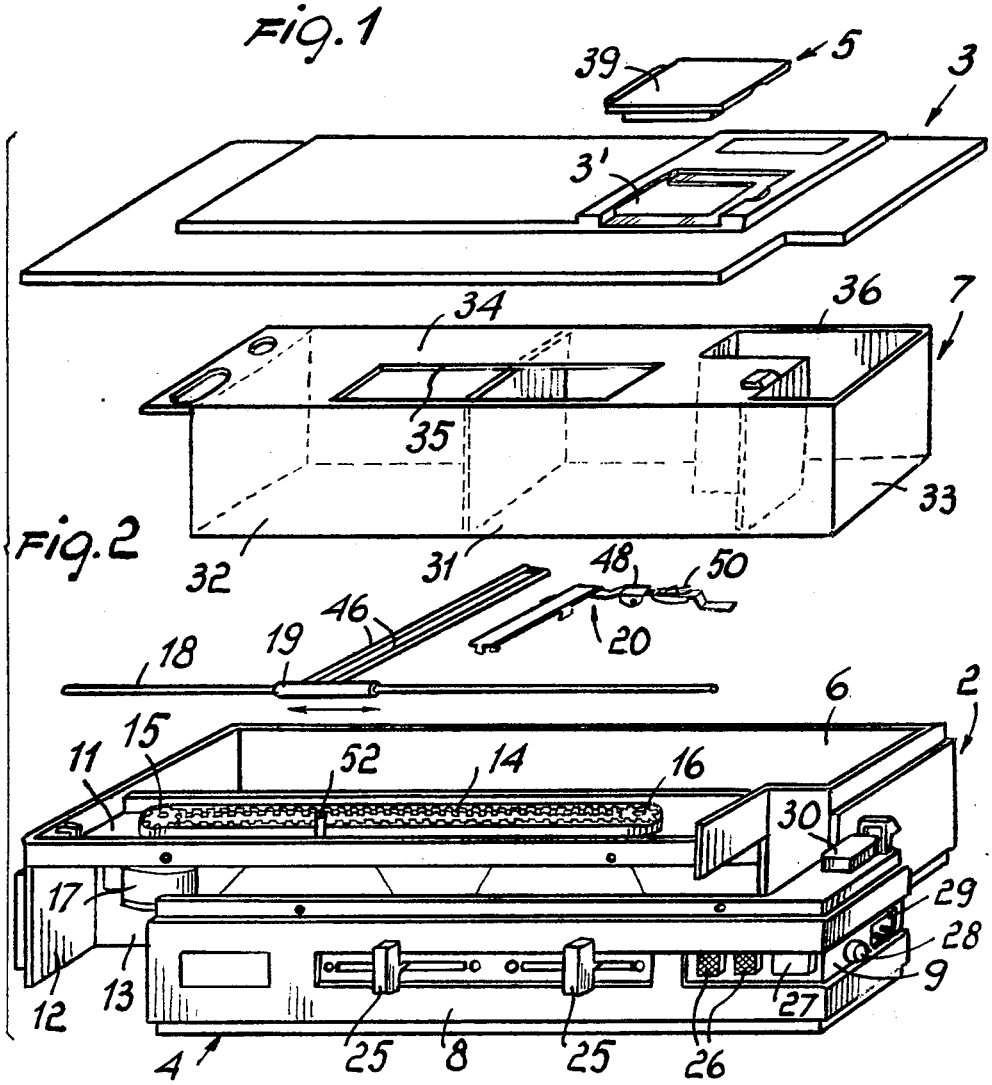
FIG. 2 is an exploded perspective view of the apparatus.
Figure 3:
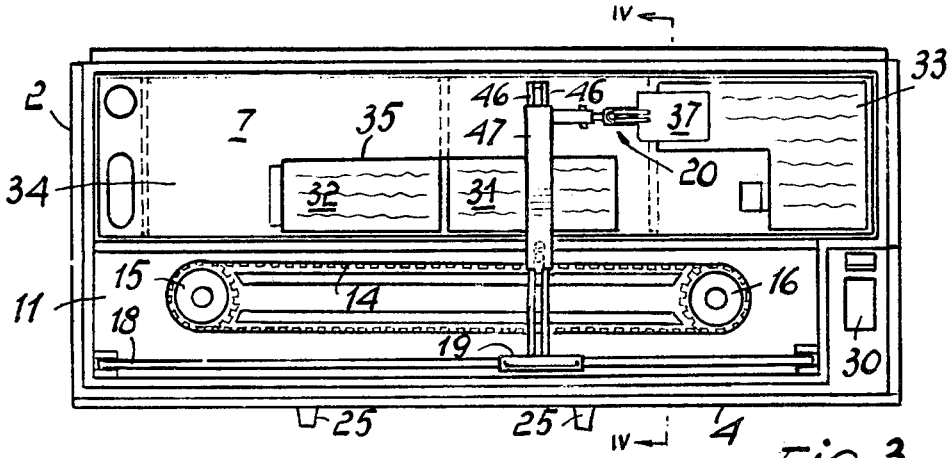
FIG. 3 is a top view of the apparatus with its cover plate removed.
Figure 4:
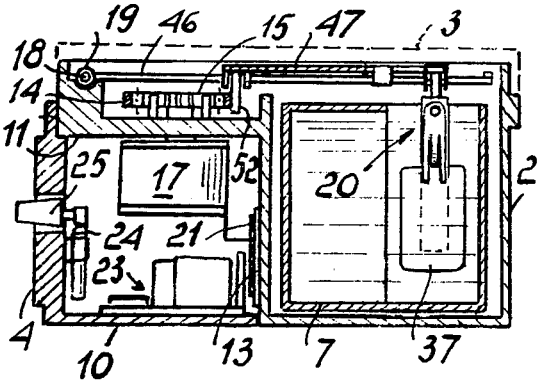
FIG. 4 is a cross-sectional view of the apparatus as taken along the line IV—IV of FIG. 3.
Figure 5:
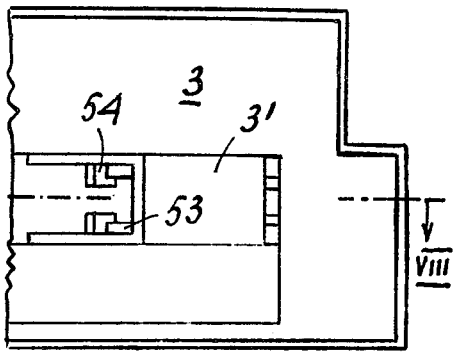
FIG. 5 is a partial top view of the plate.
Figure 12:
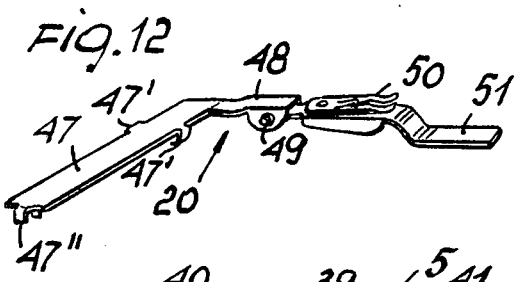
FIG. 12 shows in perspective part of the film gripping means.
Figure 18:
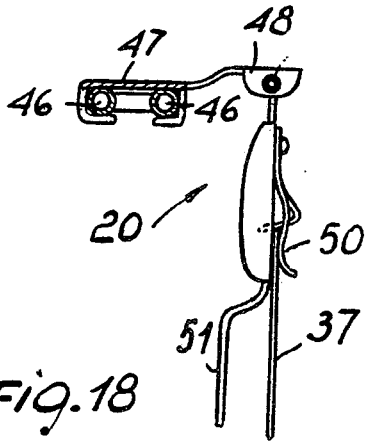
FIG. 18 is a view similar to FIG. 9 of the film gripping means, at the development bath dipping stage.

The gripping device 20, which is fed with a film from the magazine 5, should be discussed in connection with FIGS. 2, 12 and 18 as well, and in association with the drive assembly of which it is a part. From the slider 19, which is slidable on the guide 18, two arms 46 extend which form a projecting bracket. A gripper supporting slide 47 slides along the bracket which includes shoes 47′ and a hook 47″. The slide 47 has a lug 48 projecting cantilever fashion at 90° to its axis. Through a hinge 49, a gripper comprising a spring clip 50 is pivotally attached to the lug bracket and terminates in a wiping shoe 51. As visible in the drawings, the gripper is thus pivotable about an axis substantially parallel to the bracket 46. Through the hook 47″, an entraining pin 52 is engaged (FIG. 2) which is rigid with the endless chain or belt 14. Owing to the fact that the latter is movable in a plane substantially parallel to the bracket 46, the pin, in its longitudinal movement, entrains the slider 19 with the entire gripping device 20, back and forth along the guide 18, and in its transversal movement, on the sprockets 15 and 16, causes the slide 47 to slide along the bracket 46. Thus, as best deducible from FIGS. 3 and 7, the gripper is caused to move along a forward and rearward path which are parallel to each other and spaced from one another. However, the pin has also another function of importance: a magnetized lug (not shown) depends at one end therefrom and abuts, in its path, the upper ends of the solenoids 24, operating them each time through its magnetic field and determining actuating controls for the timing routine established by the circuit of the electric system 23.

The operation of the apparatus just described, and the operating sequence of the method implemented by said apparatus, may now be very easily explained in connection with FIGS. 13 to 17, as well as to previous figures as referred to hereinafter. The process is initiated with the insertion (FIG. 13) of a sealed exposed film in the loading magazine 5. It is contemplated that a periapical plate of a standardized type will be used, wherein a photosensitive film 37 is sealed within a protective case or wrapping comprising an envelope 37*a* containing a closing tab of black paper 37*b* projecting outward from the wrapping. For simplicity reason, the lead plate adjacent to the film and inserted in the envelope has been omitted. The sealed envelope 37*a* is inserted, as shown by the arrowhead A, into the magazine 5, as withdrawn from the apparatus, and in the first seat 43 through the mouth defined between wing 40 and lip 45, with the tab 37*b* extending in the direction opposite to the contour of the lip 45, from which lip the tab is folded along the arrowhead B on the edge defined by wing 40, as may be noted in FIGS. 14 and 15. The magazine is then arranged to close the window or opening 3′, as indicated by the arrowhead C in FIG. 16, being careful to leave the tab projecting outward. Thus the film is introduced in the developing dark room and can now be released from its protective wrapping; this is done by pulling with two fingers on the tab of blackened paper 37*b* slideably clamped between the cover or magazine 5 and the cover plate 3, as indicated by the arrowhead D in FIG. 9, and as shown schematically, in perspective, in FIG. 17. The film is pushed out of the wrapping and advances out of the magazine between side deflectors or guide means 53 and 54 which deviate the film from the level of the seat 43 towards the level of the gripper 20, as visible in FIG. 9, so that is inserted into the clip 50 which is now at its rest position or end of travel. At this point, the operator, after operating the switch 27, as monitored by a telltale 26, depressed the key 30 and is free to resume his former work because the apparatus will, from now on, perform all the required operations automatically, under program, through the transfer sequence a–m as explained in connection with FIG. 7, and through the mechanical events as described for each member or device. In particular, the gripping device 20 is, as explained, entrained by the pin 52 of the chain or belt 14, and wipes the cover panel 34 of the tray 7 with its shoe 51, until as it moves past the window 35 and loses support for the shoe 51, the gripper clip 50 is tilted about the hinge 49 which is substantially parallel to the cover panel 34, as shown in FIG. 18, thereby the film 37 is dipped in the corresponding bath (position c). Here the pin 52 abuts one of the solenoids 24, which emits a control signal to the timer circuit which then stops for a predetermined development time the electric motor 17. Upon the motor restarting, the clip 50 also moves and causes the film 37 first to emerge from the developing bath 31 and then to fall into the fixing bath 32, where the timing action is repeated, as is repeated at the wash-up bath 33, which the film enters at the position i and exits at the position m to return, again in plan view, to the starting position a for reinsertion into the magazine. This reinsertion is effected by passing the clip 50 between the two sides 42 of the film carrier frame of the magazine 5; in passing, the film enters the mouths 44' and is thereby conveyed to the grooved guides of the second or lower seat 44, being a blind one, where the film stops, the gripping action being released shortly afterwards, at a position for receivng a fresh film to be developed. During operation, both telltales 26 are on. Upon completion of the process, the telltale relative to the key 30 goes off and an acoustical signal is concurrently emitted to monitor that the plate is now ready for inspection. The two knobs 25 are used to adjust or change the programmed times of development and fixing, to suit any particular requirements.

The invention objects have been achieved since any applicational requirement have been met for the field where this invention is useful. The invention as described is susceptible to many modifications and variations, all of which fall within the scope of the instant inventive concept. Furthermore, all of the details may be replaced with technically equivalent elements. In practicing the invention, the dimensions and materials used may be any ones, to suit individual applications.

I claim:

1. An apparatus for developing exposed films, in particular X-ray exposed films as employed in dental applications, comprising an opaque housing, an opening in said housing, a cover for light-tight closing said opening, developing, fixing and washing baths for said films within said housing, entraining means movable along a path within said housing for entraining said films and causing immersion of said films into said developing, fixing and washing baths at subsequent times, wherein said cover defines a magazine for an exposed film wrapped in a protective wrapping having a closing tab and comprises a frame having at least one first seat therein, an exit mouth open toward said path of said entraining means and an edge adjacent said exit mouth to cause said tab of said wrapping inserted in said cover to become folded on said edge and slideably clamped between said cover and said housing and to project out of said housing when said cover is arranged within said opening, whereby pulling of said projecting tab causes advancement of said film along said at least one first seat out of said wrapping and said cover to said entraining means.

2. An apparatus as claimed in claim 1, wherein said frame has guides defining said at least one first seat and a lip adjacent said exit mouth and opposite to said edge, said lip connecting said guides at said exit mouth.

3. An apparatus as claimed in claim 1, wherein said frame further comprises a second seat having an entrance mouth at the side opposite to said exit mouth of said first seat for reinsertion of said film into said magazine upon completion of the developing thereof.

4. An apparatus as claimed in claim 1, wherein said entraining means comprise a conveyor movable along a closed path, means for driving said conveyor and for stopping said conveyor during film developing, fixing and washing steps, a bracket entrained by said conveyor to move therewith, and a gripper pivotally supported by said bracket, said gripper having clip means for clamping said film as it exits from said wrapping.

5. An apparatus as claimed in claim 4, wherein said entraining means further comprise a guide extending substantially parallel to said conveyor, a slider slideable on said guide, said bracket being secured to said slider transversally thereto, a gripper support slide slideable on said bracket, said gripper being pivotally supported by said support slide about an axis substantially parallel to said bracket, and wherein said conveyor is an endless belt and has a pin rigid therewith, said pin engaging said support slide, said endless belt being movable in a plane substantially parallel to said bracket to provide longitudinal movement of said gripper along a forward and a rearward path which are parallel to each other and spaced from one another.

6. An apparatus as claimed in claim 5, wherein said pin has one end made of magnetic material and wherein solenoids are arranged along the path of said pin to co-operate with said pin and control advancement and stopping steps of said endless belt.

7. An apparatus as claimed in claim 1, comprising a tray within said housing, said tray having receptacles for said developing, fixing and washing baths and a cover panel defining a continuous surface between said receptacles, said entraining means comprising a gripper having a wiping shoe for sliding on said continuous surface, said gripper being pivotally supported about an axis substantially parallel to said continuous surface to cause said gripper to fall into said receptacles when travelling along said path.

* * * * *